United States Patent [19]

Filippi

[11] 4,455,231

[45] * Jun. 19, 1984

[54] FLOW REGULATION DEVICE FOR WASTE WATERS

[75] Inventor: Rodolfo Filippi, Morges, Switzerland

[73] Assignee: Rentham Limited, England

[ * ] Notice: The portion of the term of this patent subsequent to Dec. 14, 1999 has been disclaimed.

[21] Appl. No.: 411,102

[22] Filed: Aug. 24, 1982

[30] Foreign Application Priority Data

Sep. 1, 1981 [CH] Switzerland ..... 5619/82

[51] Int. Cl.[3] ..... B01D 21/00

[52] U.S. Cl. ..... 210/519; 210/532.1; 137/561 A

[58] Field of Search ..... 210/767, 800–802, 210/154, 162, 163, 170, 320, 418–420, 433, 511, 512.1, 513, 519, 521, 532.1, 533.1, 533.2, 534, 541; 137/262, 561 R, 561 A

[56] References Cited

U.S. PATENT DOCUMENTS

| | | | |
|---|---|---|---|
| 3,494,475 | 2/1970 | Hedström et al. | 210/521 |
| 3,725,271 | 4/1973 | Giannotti | 210/767 |
| 3,731,811 | 5/1973 | Gustavsson | 210/519 |
| 3,914,175 | 10/1975 | Kunz | 210/802 |
| 3,962,098 | 6/1976 | Sze | 210/800 |
| 4,028,256 | 6/1977 | Pielkenrood | 210/519 |
| 4,039,458 | 8/1977 | Maisonneuve et al. | 210/539 |
| 4,118,313 | 10/1978 | Hadamovsky et al. | 210/521 |
| 4,363,731 | 12/1982 | Filippi | 210/532.1 |

*Primary Examiner*—Ernest G. Therkorn
*Assistant Examiner*—John Donofrio
*Attorney, Agent, or Firm*—Ostrolenk, Faber, Gerb & Soffen

[57] ABSTRACT

The present invention concerns a flow regulation device for waste waters, characterized in that it comprises a flood-weir constituted by a tubular member of preferably hard synthetic material, i.e., polyester. The tubular member includes an S-shaped channel which is defined by baffles and a profiled discharge wing. A reduction adapter having a tubular tapered element and an overflow member, coupled to the top thereof, is upstream of and coupled to the waste-weir.

8 Claims, 4 Drawing Figures

FLOW REGULATION DEVICE FOR WASTE WATERS

FIELD OF THE INVENTION

The present invention concerns a flow regulating device for waste waters mixed with clean rain water, to be transmitted to a purification station during a flood or after a thunderstorm, comprising a collection chamber with a first inlet opening for receiving the mixed waters, a second outlet opening for discharging the waters with a high content of waste water, and a third outlet opening for discharging the waters consisting mainly of clean rain water, wherein the collection chamber further comprises a waste-weir to guide a predetermined quantity of mixed waters with a high content of waste water from said first opening towards said second opening, and for guiding the surplus mixed waters with a high content of clean water from the first opening into the collection chamber and towards said third opening.

BACKGROUND OF THE INVENTION

Water flow regulation devices of the general type described above are known, e.g., by the Swiss Pat. No. 4363731 issued 12/14/82. These known devices replace with advantage the former "flood-weirs", which exist in various shapes, which comprise especially adjustable weirs which have the great disadvantage that they become blocked during dry periods, and allow the access of too much water to the purification station after heavy rainfall. The excess water exceeds by several times the capacity of the purification station. The device described in the Swiss patent is relatively expensive and, moreover, it is adapted to only one size of canalization so that it is necessary to provide a relative larger spreader which corresponds to all kind of sizes of existing canalizations.

OBJECT AND SUMMARY OF THE INVENTION

The present invention eliminates these drawbacks and provides a device which comprises a central tubular member of simple and economical construction which may be produced in large series.

Moreover, according to a preferred embodiment, the device, according to the invention, comprises a reduction adapter which makes it possible to adapt the same "flood-weir" to different sizes of existing canalizations.

On employment of this adapter, which may be executed as to provide different reductions, one single type of "flood-weir" may be mounted to different size canalization systems.

To achieve this object, the device of the present invention is further characterized in that the waste-weir is realized by a single piece tubular member, mounted between said first and second openings, comprising a first baffled zone for imposing an S-shaped path onto the water flow and a second zone for separating off the clean waters with an evacuation channel for the waste waters which is arranged in the last curve of the S-shaped path seen in the flow direction of the waters and a profiled discharge wing with guiding grooves, which originates at the last convex curve of the S-shaped path to avoid the formation of a stopper. The device further comprises a reduction adapter located upstream of the waste-weir and including a tapered cylinder, the small diameter of which corresponds to the diameter of the entrance of the waste-weir and the larger diameter of which corresponds to the diameter of a supply duct supplying mixed water to the first inlet opening, the reduction adapter further including an overflow member connected to the upper partition of the tapered cylinder communicating with the latter.

BRIEF DESCRIPTION OF THE DRAWINGS

Other objects and features of the present invention will become apparent from the following detailed description of a preferred embodiment of the invention taken in conjunction with the accompanying drawings.

DETAILED DESCRIPTION OF THE DRAWINGS

Figure 1:
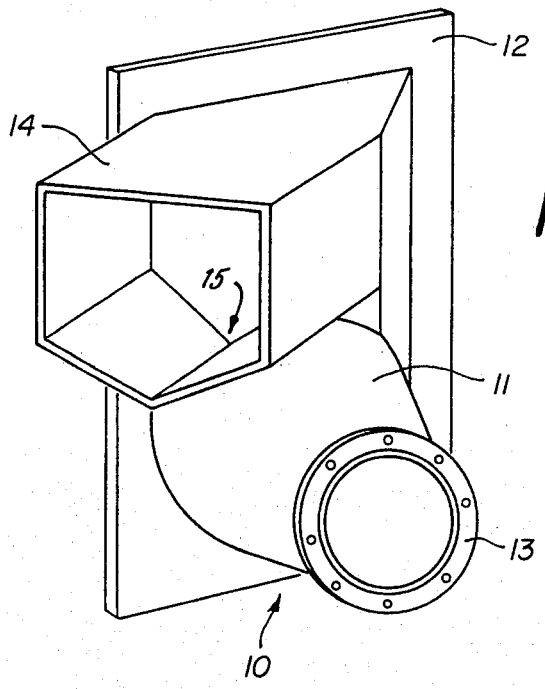
FIG. 1 is a perspective view of a reduction adapter to be used with a flow regulation device according to the invention.

With reference to the drawings, the reduction adapter 10 comprises a tapered cylinder 11 which includes a plate 12 and an annular flange 13 at its respective ends and an overflow member 14, preferably constituted, for example, by a pentagonal channel which is arranged above the tapered cylinder 11 and which communicates with the latter via an opening 15.

The central opening 16 of the mounting plate 12 corresponds to the inner diameter of a supply duct to which the regulating device is to be mounted. The opening 17 of the annular flange 13 corresponds to the diameter of the entrance of the waste-weir 22, which is illustrated in and described below. The overflow member 14, which communicates with the tapered cylinder 11 via the opening 15, makes it possible to absorb the fraction of waters coming from the canalization through the opening 16 which cannot be discharged via the flood-weir 22 by passing through the opening 17 due to the fact that an overflow of water has been created by the rain water. These excess waters, which comprise a large content of clean water, are recharged into the collection chamber (not shown) where they join the water which was evacuated from the weir 22 via its top opening 30, guided by the discharge wing 26, and is finally discharged from the collection chamber via the collection chamber third opening which is connected to the canalization of essentially the same size as the supply duct. Relatively clean water exits through top opening 30 of weir 22 since relatively dirty water will be heavier and will tend to stay at the bottom of weir 22 and exit via the opening at the right side of weir 22 (as viewed in FIG. 4) which leads to the second outlet opening in the collection chamber.

Figure 4:
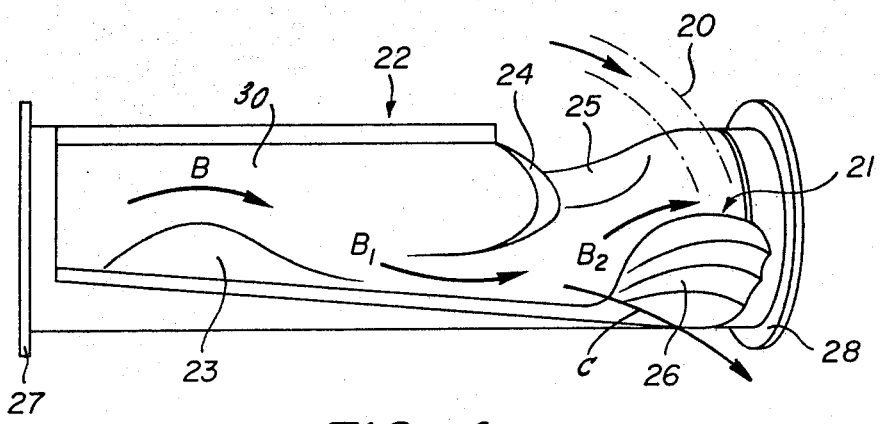
FIG. 4 is a top view of the tubular element constituting the flood-weir of the flow regulation device according to the invention.

FIG. 4 illustrates the flood-weir 22, which is constituted by a single member, which is slightly bent, and which is molded of hard synthetic material, e.g., a polymerized resin. Baffles 23, 24 and 25 define an S-shaped channel, which is illustrated by arrows B, B1 and B2, which lead the waters containing a high content of waste water towards the second opening of the collection chamber (an exemplary collection chamber is disclosed in application Ser. No. 208,275, filed Nov. 19, 1980, now U.S. Pat. No. 4,363,731, whose disclosure is incorporated herein by reference).

The discharge wing 26, profiled in the shape of a thread to avoid the formation of deposits by auto-cleaning, makes it possible to discharge clearer water exiting through the opening 30 in the top of weir 22 (see Arrow C) into the interior of the collection chamber, where it leaves through the third opening. A lateral opening 18 in reduction adapter 10 (FIG. 3) is covered by tilted parallel shutter elements 19 which guide excess clean water along path 20 (FIG. 4) and into the turbulence zone 21 adjacent the discharge wing 26. This water creates a counter-current in turbulence zone 21 which helps prevent the formation of deposits on wing 26 which might otherwise form a blockage of the passage to the second outlet opening. On either side of the tubular weir 22, there are flanges 27, 28, respectively, which make it possible to fix the weir 22 to the reduction adapter 10 and to the tube, respectively, (not shown) which leads to the second opening of the collection chamber.

Figure 2:
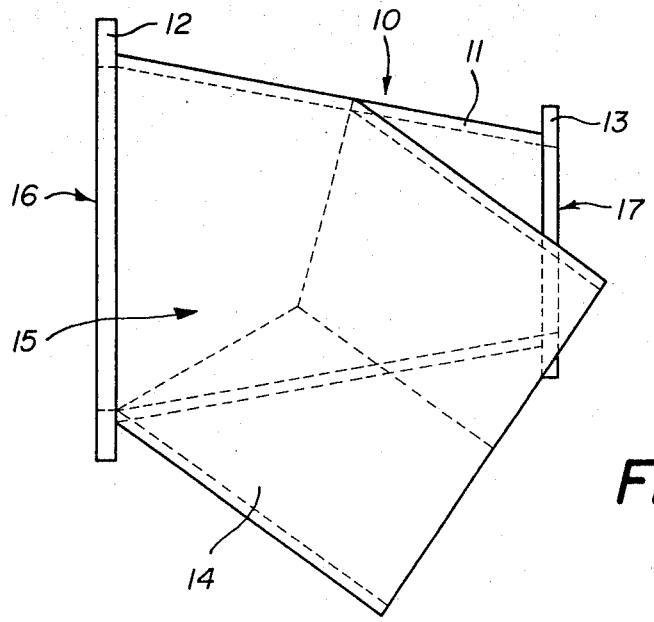
FIG. 2 is a top view of the reduction adapter according to FIG. 1.
Figure 3:
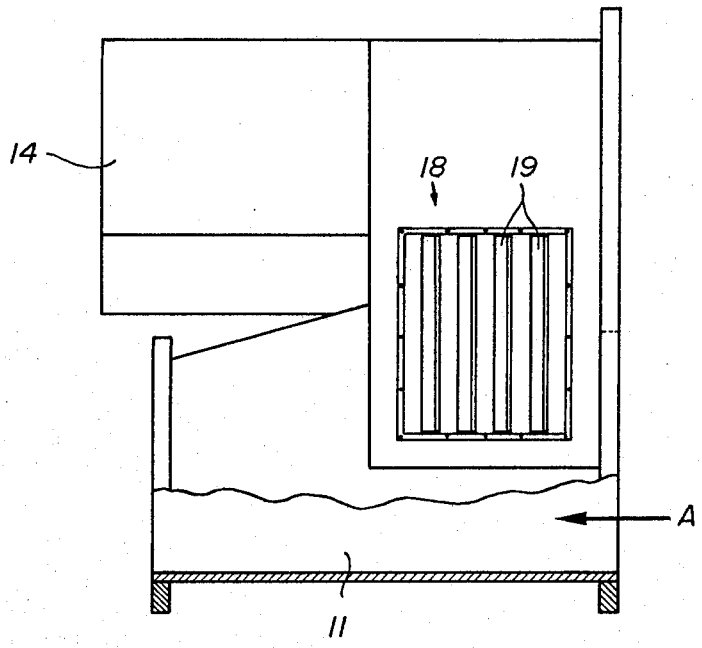
FIG. 3 is a vertical cross-section of a preferred embodiment of a reduction adapter according to FIG. 1.

The flood-weir 22, according to FIG. 4, and the reduction adapter 10, according to FIGS. 1–3, are preferably mounted one after the other (the weir 22 being downstream of the adapter 10) inside the collection chamber. Thereby, the flood-weirs, which are manufactured by molding, may be produced in larger series and be combined later with different adapters 10, which in adapters 10 are to be fixed to the front partition of the collection chamber, comprising different entrance openings.

The overflow member 14 is dimensioned in a way to assure that all waters, coming through the opening 16, can be absorbed, either via the weir 22 or via the overflow member 14. The member 14 also is dimensioned in a manner to assure the absorption of at least the maximum difference of the water-flows coming through the supply duct and leaving the weir 22.

The discharge wing 26 of the weir 22 preferably comprises a set of guiding grooves whose profile is smooth and progressive and without sharp angles to allow the waste contained in the waste water to be guided out through the right hand opening of weir 22 and through the second opening in the collection chamber. The major advantage of the described flood-weir, over the weirs of the prior art, is that it does not need any control.

The present invention may be embodied in other specific forms without department for the spirit or essential attributes thereof and, accordingly, reference should be made to the appended claims, rather than to the foregoing specification as indicating the scope of the invention.

What is claimed is:

1. A flow regulation device for receiving mixed water containing both clean rain water and polluted waste water and for separating said clean rain water from said waste water, said flow regulating device comprising:

a collection chamber having a first, inlet opening for receiving said mixed water, a second, outlet opening for discharging a portion of said mixed water which has a relatively high content of waste, and a third, outlet opening for discharging a portion of said mixed water which is mainly clean rain water;

a reduction adapter including a tapered cylinder having a smaller and a larger diameter end, said larger diameter end corresponding to the diameter of a supply duct which supplies said mixed water to said first inlet opening, said reduction adapter also including an overflow member connected to the upper portion of said tapered cylinder for permitting relatively clean excess water passing into said reduction adapter to flow through said overflow member and into said collection chamber; and a waste-weir including a single piece tubular member having an entrance end and an exit end, said entrance end being connected to said smaller diameter end of said tapered cylinder, said exit end being coupled to said second opening in said collection chamber, said tubular member including a first baffled zone for imposing an S-shaped path onto the flow of said mixed water as it moves downstream from said entrance end to said exit end of said tubular member and a second baffled zone for separating said portion of said mixed water which has a relatively high content of waste from surplus mixed water entering said tubular member and having a high content of clean rain water, an opening formed in the top of said tubular member through which said surplus mixed water having a high content of clean rain water can exit from said tubular member into said collection chamber; and means for guiding said relatively clean water which has entered said collection chamber to said third outlet opening in said collection chamber.

2. A flow regulation device according to claim 1, wherein said overflow member has a cross-section which is sufficient to absorb at least the maximum difference between the quantity of water which enters said collection chamber through said first, inlet opening and a quantity of water which exits said collection chamber through said second, outlet opening.

3. A flow regulation device according to claim 1, wherein said tubular member further includes a profile discharge wing having guiding grooves and originating at the downstream curve of said S-shaped path to avoid formation of a stopper.

4. A flow regulation device according to claim 3, wherein said reduction adapter includes means for causing excess water to flow into said separation zone of said waste-weir at the junction between said outlet end of said waste-weir and said discharge wing so as to create a tubulence zone and thereby avoid the formation of solid deposits in this area.

5. A flow regulation device according to claim 4, wherein said means comprises a lateral opening formed in said reduction adapter and tilted parallel shutter elements covering said lateral opening in said reduction adapter and guiding said excess clean water into said tubulence zone.

6. A flow regulation device according to claim 3, wherein said guiding grooves are in the form of an endless screw.

7. A flow regulation device according to claim 1, wherein said tubular member consists of a single molded hard synthetic material which is resistent to shock, chemical additives located in said mixed water and variations in temperature.

8. A flow regulation device according to claim 7, wherein said synthetic material is a polymerized resin.

* * * * *